US009458987B2

(12) United States Patent
Jungwirth et al.

(10) Patent No.: US 9,458,987 B2
(45) Date of Patent: Oct. 4, 2016

(54) MULTI-WAVELENGTH LIGHT EMITTING ASSEMBLY

(71) Applicant: THE BOEING COMPANY, Chicago, IL (US)

(72) Inventors: Douglas R. Jungwirth, Porter Ranch, CA (US); Anton M. Bouckaert, Simi Valley, CA (US)

(73) Assignee: The Boeing Company, Chicago, IL (US)

( * ) Notice: Subject to any disclaimer, the term of this patent is extended or adjusted under 35 U.S.C. 154(b) by 281 days.

(21) Appl. No.: 14/458,317

(22) Filed: Aug. 13, 2014

(65) Prior Publication Data

US 2016/0047529 A1 Feb. 18, 2016

(51) Int. Cl.

| | |
|---|---|
| ***F21V 7/04*** | (2006.01) |
| ***F21V 9/00*** | (2015.01) |
| ***F21V 17/02*** | (2006.01) |
| *F21Y 101/02* | (2006.01) |

(52) U.S. Cl.

CPC . *F21V 7/04* (2013.01); *F21V 9/00* (2013.01); *F21V 17/02* (2013.01); *F21Y 2101/02* (2013.01)

(58) Field of Classification Search

CPC ..... F21V 7/04; F21V 9/00; F21V 17/02
See application file for complete search history.

(56) References Cited

U.S. PATENT DOCUMENTS

| | | | | |
|---|---|---|---|---|
| 2003/0137834 | A1* | 7/2003 | Jigamian | F21L 4/00 362/205 |
| 2006/0023457 | A1* | 2/2006 | Leadford | F21V 13/04 362/297 |
| 2012/0212963 | A1* | 8/2012 | Jigamian | F21V 17/02 362/263 |

OTHER PUBLICATIONS

"This BMW Has Frickin' Laser Beams for Headlights," posted Dec. 23, 2013 at http://www.hufingtonpost.com/2013/12/23/bmw-laser-headlights_n_4493794.

* cited by examiner

*Primary Examiner* — Mary Ellen Bowman
(74) *Attorney, Agent, or Firm* — Joseph M. Butscher; The Small Patent Law Group, LLC

(57) ABSTRACT

A light assembly may include a reflector having a focal point in space, and a first light source configured to generate a first light at a first wavelength proximate to the focal point during a first illumination mode. The first light reflects off the reflector as a first collimated beam at the first wavelength. One or more second light sources are configured to direct one or more second light beams at one or more different wavelengths towards the focal point during a second illumination mode. The different wavelength(s) differ from the first wavelength. At least a portion of the second light beam(s) reflects off the reflector as one or more second collimated beams at the different wavelength(s).

20 Claims, 4 Drawing Sheets

MULTI-WAVELENGTH LIGHT EMITTING ASSEMBLY

BACKGROUND OF THE DISCLOSURE

Embodiments of the present disclosure generally relate to light assemblies, such as searchlights, flashlights, vehicle headlights, and the like, and, more particularly, to light assemblies that are configured to emit light at various wavelengths.

High-power searchlights are used in various settings to focus light energy onto a particular target. A typical searchlight includes an arc lamp that outputs light that is reflected by conic mirrors.

In order to emit light at different wavelengths (so that different colored lights are emitted), some known light assemblies include one or more filters that are positioned in front of a light source. However, a filter positioned in front of a light source may be inefficient. Also, a mechanical assembly may be used to move the filter in and out of position, thereby adding cost and complexity to the light assembly.

Other known light assemblies include multi-color light emitting diodes (LEDs) that include a plurality of optical elements. For example, a known illuminator includes multiple sets of optics that are used to emit light from the LEDs. The use of LED configurations often adds cost and complexity to a light assembly.

Another known light assembly includes a vertical cavity surface emitting laser. However, such a light assembly presents eye safety hazards, as the emitted light is a highly collimated laser beam. If the highly collimated laser beam is directed into eyes of an individual, blindness (such as temporary blindness) or other eye damage may result.

SUMMARY OF THE DISCLOSURE

Certain embodiments of the present disclosure provide a light assembly that may include a reflector having a focal point in space. A first light source is configured to generate a first light at a first wavelength proximate to the focal point during a first illumination mode. The first light reflects off the reflector as a first collimated beam at the first wavelength. One or more second light sources are configured to direct one or more second light beams at one or more different wavelengths towards the focal point during a second illumination mode. The different wavelength(s) differ from the first wavelength. At least a portion of the second light beam(s) reflects off the reflector as one or more second collimated beams at the different wavelength(s).

In at least one embodiment, the second light source(s) are configured to direct the second light beam(s) unimpeded through the focal point to the reflector. The second collimated beam(s) may be of the same intensity and focus as the second light beam(s) as emitted from the second light source(s).

In at least one embodiment, the light assembly may include a light scattering member positioned at the focal point. The light scattering beam scatters the second light beam(s). The second collimated beam(s) may be expanded in relation to the second light bearn(s) as emitted from the second light source(s). The light scattering member may include at least a portion of the first light source. The portion(s) of the first light source may include at least an outer surface of an electrode. Alternatively, the light scattering member may include a light scattering medium that is not configured to independently generate light.

The light assembly may also include an actuator operatively connected to the first light source. The actuator may be configured to selectively move at least a portion of the first light source into and away from the focal point.

The first light source may include an arc lamp, such as a Xenon lamp. The second light source(s) may include one or more laser emitting devices.

Certain embodiments of the present disclosure provide a method of operating a light assembly that may include generating a first light at a first wavelength with a first light source during a first illumination mode, reflecting the first light off a reflector as a first collimated beam at the first wavelength, directing one or more second light beams at one or more different wavelengths towards a focal point of the reflector from one or more second light sources during a second illumination mode that differs from the first illumination mode, and reflecting at least a portion of the second light beam(s) off the reflector as one or more second collimated beams at the different wavelength(s).

Certain embodiments of the present disclosure provide a light assembly that may include a reflector having a focal point in space, and one or more light sources secured with respect to an outer surface of the reflector. The light source(s) are configured to direct one or more light beams at one or more different wavelengths towards the focal point. At least a portion of the light beam(s) reflects off the reflector as one or more collimated beams at the different wavelength(s). The one or more light sources may be outside of a reflecting volume of the reflector.

DETAILED DESCRIPTION OF THE DISCLOSURE

The foregoing summary, as well as the following detailed description of certain embodiments will be better understood when read in conjunction with the appended drawings. As used herein, an element or step recited in the singular and proceeded with the word "a" or "an" should be understood as not excluding plural of the elements or steps, unless such exclusion is explicitly stated. Further, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional elements not having that property.

Embodiments of the present disclosure provide a light assembly that may include one or more laser emitting devices that are configured to emit lasers toward a focal point of a reflector. The reflector may be a parabolic or elliptical reflector, for example. The focal point may be between electrodes of a lamp, such as a standard lamp used in a light assembly. In another embodiment, a Lambertian surface may be positioned at the focal point of the reflector. As an example, an outer surface of an electrode of a lamp, such as a Xenon short-arc lamp, may provide the Lambertian surface. Lasers emitted from the laser emitting device(s) are directed onto the Lambertian surface, which scatters and diffuses the light so that an expanded beam of light is emitted through the aperture or outlet of the light assembly. The scattered light and resulting expanded beam of light may be incoherent and therefore safe for viewing, even if pointed directly into the eyes of an individual.

Embodiments of the present disclosure provide a light assembly that is configured to emit light at multiple wavelengths using the same optics. For example, the same reflector may be used to reflect light of varying wavelengths into multiple collimated beams through an aperture or outlet of the light assembly.

Embodiments of the present disclosure provide a light assembly that may provide illumination from multiple sources, such as a lamp, and one or more other light sources (such as laser emitting devices) that are configured to emit light at different wavelengths. For example, the light assembly may be selectively switched between a first illumination mode in which the lamp is activated to provide illumination at a first wavelength, and a second illumination mode in which the lamp is deactivated, and the laser(s) is activated to provide reflected laser light that provides illumination at one or more second wavelengths that differ from the first wavelength.

Figure 1:
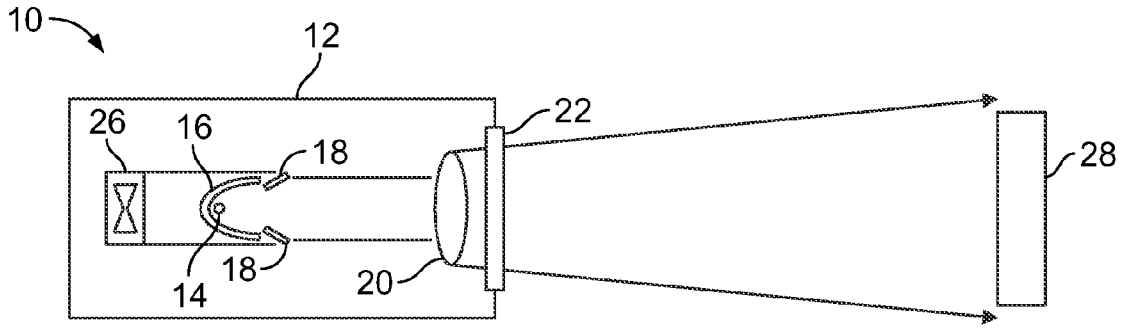
FIG. 1 illustrates a schematic diagram of a light assembly, according to an embodiment of the present disclosure.

FIG. 1 illustrates a schematic diagram of a light assembly 10, according to an embodiment of the present disclosure. The light assembly 10 may include a housing 12 that securely retains a light source 14, a reflector 16, one or more additional light sources 18 (such as laser emitting devices) secured to the housing 12 and/or the reflector 16, a focusing lens 20, and a transparent outlet or aperture 22.

The light source 14 may be or include an arc lamp that is configured to generate white light, for example. For example, the light source 14 may be a Xenon short-arc lamp. The reflector 16 may be a conic or parabolic mirror that is configured to direct the emitted light from the arc lamp into the focusing lens 20.

The light assembly 10 may also include a fan 26 configured to circulate air flow through the light assembly 10 to dissipate any heat generated by the light source 14 and/or the light sources 18. The housing 12 may also include one or more vents that allow air to pass into and out of the housing. Alternatively, the light assembly 10 may not include the fan 26. For example, instead of the fan 26, the light assembly 10 may include vents that are configured to allow air to pass therethrough to cool the internal components of the light assembly 10.

Alternatively, the light source 14 may be various other types of light sources other than an arc lamp. For example, the light source may be an incandescent light bulb, a fluorescent light bulb, one or more light emitting diodes (LEDs), or the like.

In operation, the light source 14 may be activated to emit light from the light assembly 10 at a first wavelength, such as that which defines white light. For example, the light source 14 may be activated to emit white light through the aperture 22 onto a target 28. In order to emit light at one or more different wavelengths than the light emitted from the light source 14, the light source 14 may be deactivated, and the separate and distinct light sources 18 (such as laser emitting devices) may be activated to emit light at one or more wavelengths (that differ from the first wavelength) from the light assembly 10.

Figure 2:
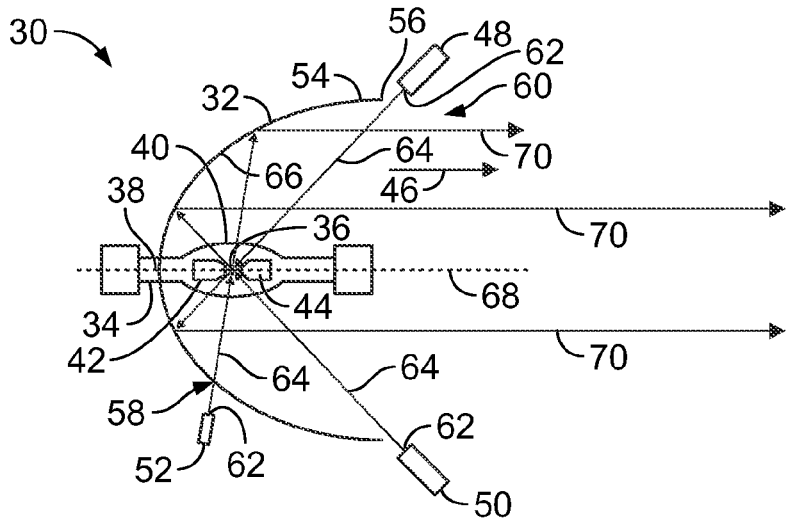
FIG. 2 illustrates a schematic diagram of a light assembly, according to an embodiment of the present disclosure.

FIG. 2 illustrates a schematic diagram of a light assembly 30, according to an embodiment of the present disclosure. For the sake of clarity, the housing, the focusing lens, and other components are not shown in FIG. 2.

The light assembly 30 includes a reflector 32, such as a parabolic or elliptical reflector, and a light source 34 configured to emit light at a first wavelength at a focal point 36 of the reflector 32. The light source 34 may be or include a Xenon short-arc lamp including a clear tube 38 having an expanded, bulbous center 40 and opposing electrodes 42 and 44 secured within the clear tube 38. The electrodes 42 and 44 may be on opposite sides of the focal point 36. For example, the electrodes 42 and 44 may be evenly spaced from the focal point 36. In operation, the light source 34 is activated to generate light at a first wavelength. For example, the electrodes 42 and 44 may be energized so that a gas, such as Xenon, between the electrodes 42 and 44 is heated and energized, thereby emitting the light that is reflected by the reflector 32 in a collimated direction 46. The light generated by the light source 34 may be of a first wavelength, such as that which defines white light. Accordingly, in a first illumination mode, the light source 34 may generate light that is reflected by the reflector 32 into a collimated beam of light that is directed through an aperture of the light assembly 30.

The light assembly 30 may also include additional light sources 48, 50, and 52, which may be secured to (or otherwise with respect to) an outer surface 54 of the reflector 32. Each light source 48, 50, and 52 may be or include a laser-emitting device that is configured to emit a light beam (such as a laser beam) at a wavelength that differs from the light that is emitted from the light source 34. The light beam emitted from each light source 48, 50, and 52 may be different. For example, the light beam emitted from each of the light sources 48, 50, or 52 may differ from the light beam that is emitted by each of the other light sources 48, 50, or 52. Alternatively, the light beams emitted from each light source 48, 50, and 52 may be at the same wavelength (although a different wavelength than the light that is emitted by the light source 34).

The light sources 48 and 50 may be secured to an outer edge 56 of the reflector 32, such as through fasteners, clamps, adhesives, and/or the like. The light source 52 may be secured to the outer surface 54 of the reflector 32 and aligned with channel 58 formed through the reflector 32. For example, the channel 58 may be formed through a tool that punctures the reflector 32. The light source 52 is configured to emit a light beam toward the focal point 36 through the channel 58. As shown, the structure of each light source 48, 50, and 52 may not extend into an internal volume or space 60 of the reflector 32. As an example, the structure of each light source 48, 50, and 52 may not be within an internal area or volume of the reflector 32 through which light is reflected off an internal reflective surface 66 of the reflector as a collimated beam. As such, each light source 48, 50, and 52 may be outside of a reflecting volume of the reflector 32. The reflecting volume may be the area within the reflector 32 through which light beams and collimated light beams pass.

Each of the light sources 48, 50, and 52 includes an output end 62 that is oriented to direct an emitted light beam 64 through the focal point 36 of the reflector 32. For example, all of the light sources 48, 50, and 52 may be configured to emit infrared light beams through the focal point 36. In at least one other embodiment, the light source 48 may be configured to emit a blue laser beam, while the light source 50 may be configured to emit a red laser beam, and the light source 52 may be configured to emit a yellow laser beam. The light assembly 10 may include more or less light sources 48, 50, and 52 than shown, positioned at various locations along or extending from the outer surface 54 of the reflector 32.

In operation, in order to emit light at a wavelength that differs from that emitted by the light source 34, the light source 34 may be deactivated. One or more of the light sources 48, 50, and 52 may then be activated to emit light beams through the focal point 36. All of the light sources 48, 50, and 52 may be activated at the same time, or less than all of the light sources 48, 50 and 52 may be activated. As the emitted light beams 64 from the light sources 48, 50, and 52 pass through the focal point 36, the emitted light beams 64 reflect off an inner reflective surface 66 of the reflector 32. Because the emitted light beams 64 pass through the focal point 36, the emitted light beams 64 may reflect at angles of reflection that are parallel with a longitudinal axis 68 of the light assembly 30. As such, as the emitted light beams 64 pass through the focal point 36 and reflect off the inner reflective surface 66, each of the emitted light beams 64 form a focused collimated beam 70 that is emitted from the light assembly 30, thereby providing parallel focused light beams. The collimated beams 70 that pass out of the outlet or aperture of the light assembly 30 may be focused and generally have the same characteristics (for example, focus, beam width and intensity) as the light beam 64 as emitted from the light sources 48 and 50.

Accordingly, in a second illumination mode, one or more of light sources 48, 50, and 52 34 may direct light beams through the focal point 36. The light beam(s) are reflected by the reflector 32 into collimated beam(s) of light that are directed through an aperture of the light assembly 30. Accordingly, both the first and second illumination modes use the same reflector 32 (instead of separate and distinct optics) to direct collimated beams out of the light assembly 30.

As shown in FIG. 2, each of the light sources 48, 50, and 52 may be or include a laser emitting device. Each of the light sources 48, 50, and 52 may be configured to emit a laser beam of a different color, for example. The combination of emitted light beams from the light sources 48, 50, and 52 and/or a near infrared light beam may be focused on the focal point 36 and reflected off the reflector 32 and through a single outlet or aperture.

The light sources 48, 50, and 52 emit and direct the generated light beams 64 unimpeded through the focal point 36 to the reflector 32. The resulting collimated beams 70 collimated beams are of the same intensity and focus as the light beams 64 as they are emitted from the light sources 48, 50, and 52.

As described above, in order to emit light from the light assembly 30 at a first wavelength, such as that of white light, the light source 34 (such as a Xenon lamp) may be activated, while the light sources 48, 50, and 52 are deactivated. In order to emit light from the light assembly 30 at one or more wavelengths that different from the first wavelength, the light source 34 may be deactivated, while one or more of the light sources 48, 50, and 52 are activated.

An existing light assembly having a standard light source, such as a Xenon lamp, may be retrofit with one or more additional light sources, such as laser emitting devices, that emit light beams at one or more different wavelengths that differ from the light emitted by the standard light source. The same reflector 32 may be used with respect to the emitted light beams of different wavelengths. The additional light sources may be mounted to the housing and/or the reflector as described above so that emitted light beams from the additional light sources pass through the focal point of the reflector. Any number of additional light sources may be used. For example, one or more laser emitting devices that are configured to emit infrared light beams may be used. In at least one embodiment, one or more laser emitting devices that are configured to emit light beams of various other wavelengths within the R-O-Y-G-B-I-V color spectrum may be used. For example, as shown in FIG. 2, the light source 48 may be a laser-emitting device that is configured to emit a blue laser beam, the light source 50 may be a laser-emitting device that is configured to emit a red laser beam, and the light source 52 may be a laser-emitting device that is configured to emit a yellow laser beam.

Figure 3:
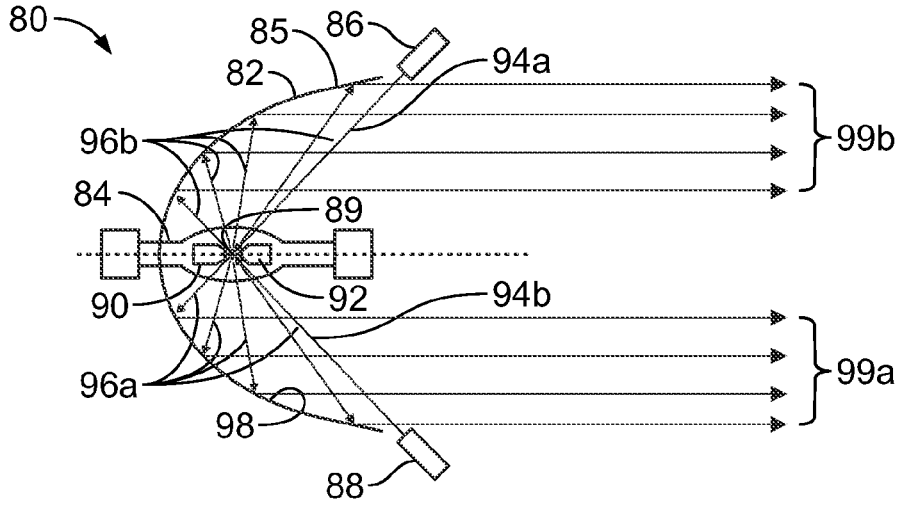
FIG. 3 illustrates a schematic diagram of a light assembly, according to an embodiment of the present disclosure.

FIG. 3 illustrates a schematic diagram of a light assembly 80, according to an embodiment of the present disclosure. The light assembly 80 may include a reflector 82 and a light source 84, such as a Xenon lamp, as described above. Two additional light sources 86 and 88, such as separate and distinct laser emitting devices, may be secured with respect to an outer surface 85 of the reflector 82 and are configured to emit light beams toward a focal point 89 of the reflector.

As shown, a portion of the light source 84 may be positioned at the focal point 89. For example, a portion of an electrode 90 of the light source 84 may be positioned at the focal point 89 of the reflector 82. The outer surface of the electrode 90 provides a Lambertian or other scattering surface that diffuses light that impinges thereon. A Lambertian surface generally has the same radiance when viewed from any angle. To the human eye, a Lambertian surface has the same apparent brightness (or luminance) and radiance because, although the emitted power from a given area element may be reduced by the cosine of the emission angle, the apparent size of the observed area, as seen by an individual, is decreased by a corresponding amount. Light reflected off a Lambertian surface scatters in all directions, and is generally uniform throughout. A Lambertian surface may not absorb any particular wavelength of light.

As shown in FIG. 3, the light source 84 may be slightly defocused so that the focal point 89 of the reflector 82 is not between the electrodes 90 and 92. Instead, the electrode 90 has a portion (for example, a scattering surface) that is positioned at the focal point 89. As light beams 94*a* and 94*b* are emitted from the light sources 86 and 88, respectively, the light beams 94*a* and 94*b* impinge upon the scattering or Lambertian surface of the electrode 90 at the focal point 89. The Lambertian or scattering surface scatters the light beams 94*a* and 94*b* in all directions, thereby providing scattered light components 96*a* and 96*b* (from the light sources 86 and 88, respectively) that reflect off an inner reflective surface 98 of the reflector 82. The scattered light components 96*a* and 96*b* are reflected off the reflector as expanded collimated beams 99*a* and 99*b*, respectively, which may be defocused, diffused, or otherwise expanded in relation to the emitted light beams 94*a* and 94*b*.

While FIG. 3 illustrates the light sources 86 and 88, it is to be understood that more or less light sources that emit light at a different wavelength(s) than the light source 84 may be used. For example, the light assembly 10 may include two, three, four, five, . . . n light sources that are configured to emit light beams at one or more wavelengths that differ from the light emitted from the light source 84.

By scattering or diffusing the emitted light beams 94*a* and 94*b* from the light sources 86 and 88 with a light scattering member, such as an outer surface of the electrode 90, the resulting expanded collimated beams 99*a* and 99*b* reflect off the reflector 82 and out of a single outlet or aperture of the light assembly 80. The expanded beams 99*a* and 99*b* eliminate, minimize, or otherwise reduce the possibility of eye hazard that may otherwise be present in focused laser light, for example.

The collimated beams 99*a* and 99*b* may be expanded in relation to the light beams 94*a* and 94*b* as emitted from the light sources 84 and 86, respectively. The collimated beams 99*a* and 99*b* may be diffused, less focused, wider, and less coherent than the light beams 94*a* and 94*b* as generated and emitted from the light sources 84 and 86, respectively.

Figure 4:
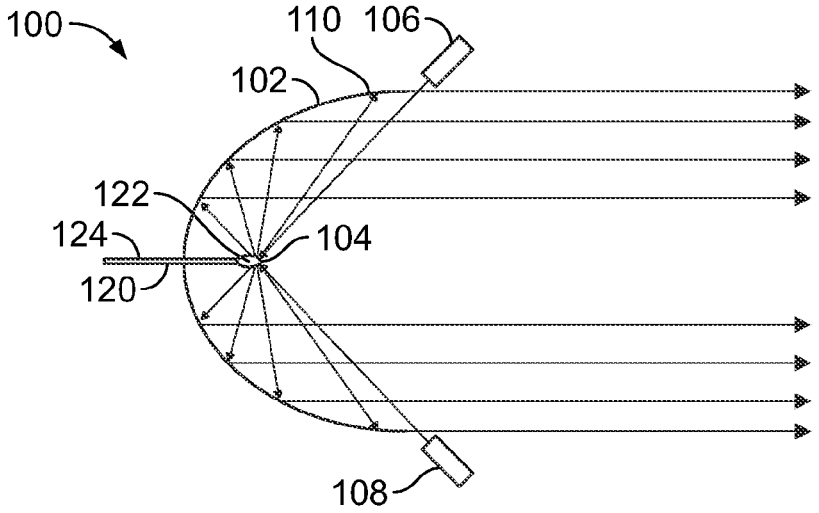
FIG. 4 illustrates a schematic diagram of a light assembly, according to an embodiment of the present disclosure.

FIG. 4 illustrates a schematic diagram of a light assembly 100, according to an embodiment of the present disclosure. The light assembly 100 is similar to the light assembly 80 shown in FIG. 3, and may include a reflector 102 having a focal point 104 and one or more light sources 106 and 108, such as laser-emitting devices, secured with respect to an outer surface 110 of the reflector 102 and configured to emit light toward the focal point 104. The light emitted from each of the light sources 106 and 108 may be the same, or have different wavelengths, and both may emit light beams that differ from white light.

In contrast to the light assembly 80, however, instead of a white light source, a light scattering member 120 may be secured to the reflector 102 and include a scattering medium 122, such as a metal sphere, lens, or the like, positioned at the focal point 104. The light scattering medium 122 may be a structure that is not configured to independently generate light. For example, the light scattering medium 122 may not be a portion of a light source. The light scattering member 120 may include an extension structure 124, such as an arm, leg, beam, post, stud, pin, column, or the like, that extends the light scattering medium 122 into the focal point 104. The scattering medium 122 may provide a Lambertian surface. As emitted light from the light sources 106 and 108 impinges on the scattering medium 122, the light scatters and reflects off the reflector 102 as one or more expanded collimated beams, as described above.

Figure 5:
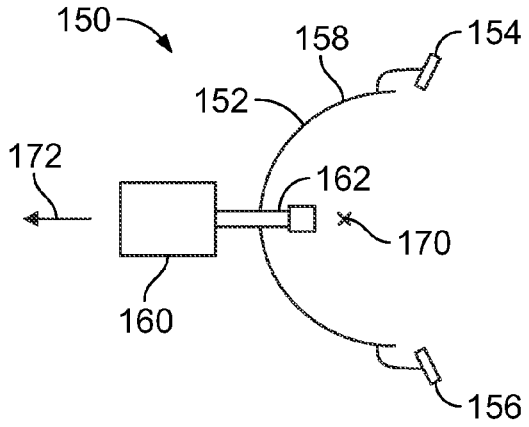
FIG. 5 illustrates a schematic diagram of a light assembly, according to an embodiment of the present disclosure.

FIG. 5 illustrates a schematic diagram of a light assembly 150, according to an embodiment of the present disclosure. The light assembly 150 may include a reflector 152, one or more light sources 154 and 156 secured with respect to an outer surface 158 of the reflector 152 (such as through clamps, adhesives, fasteners, or the like), and an actuator 160 operatively connected to a light scattering member 162, such as a light source configured to emit white light (as described shown in FIGS. 1-3) or a mechanical structure that is not configured to emit light, but simply provides a Lambertian surface, such as shown FIG. 4.

The actuator 160 is configured to move the light scattering member 162 into and out of a focal point 170 of the reflector 152. When the light scattering member 162 recedes from the focal point 170 in the direction of arrow 172, the emitted light from the light sources 154 and 156 passes through the focal point 170 and reflects off the reflector as a coherent, focused collimated beam. When the light scattering member 162 is moved into the focal point 170, the emitted light from the light sources 154 and 156 encounters a portion of the light scattering member 162, such as a Lambertian surface, and scatters, thereby providing an incoherent, diffused, expanded collimated beam.

The actuator 160 may be a motor, for example, that is operatively connected to the light scattering member 162. In at least one other embodiment, the actuator 160 may be a mechanical link, such as a handle, clamp, worm screw or the like, that operatively connects to the light scattering member 162 and is configured to be manually engaged in order to move the light scattering member 162 into and away from the focal point 170.

Figure 9:
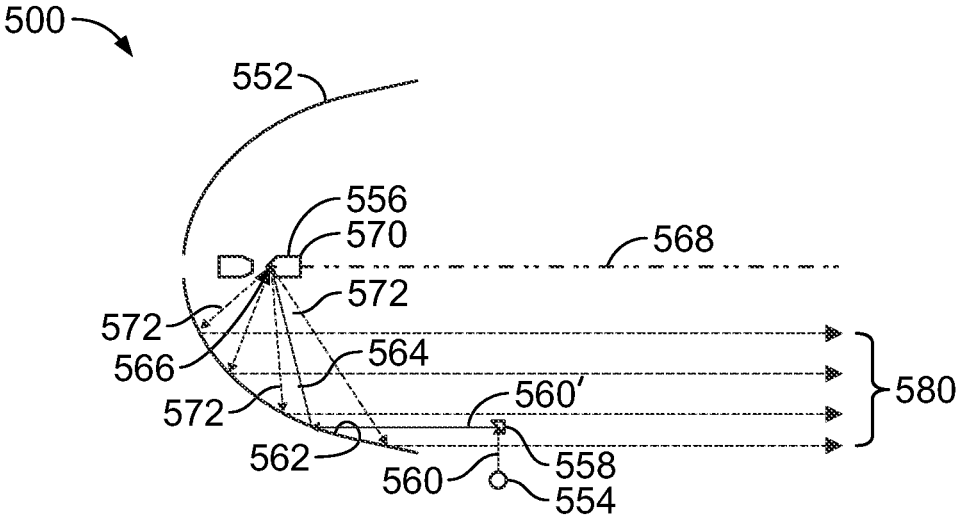
FIG. 9 illustrates a schematic diagram of a light assembly, according to an embodiment of the present disclosure.

FIG. 9 illustrates a schematic diagram of a light assembly 500, according to an embodiment of the present disclosure. The light assembly 500 may include a reflector 552, at least one light source 554 outside of the reflector 552, and an additional light source 556, such as source of white light, within the reflector 552. An additional reflective member 558, such as a mirror disposed at a forty five degree angle with respect to an emitted light beam 560 from the light source 554, may be positioned within the reflector 552.

The reflective member 558 is positioned and configured to reflect the emitted light beam 560 to be parallel with the longitudinal axis 568 of the reflector 552. The incoming light beam 560' that is reflected off the reflective member 558 towards a reflective surface 562 of the reflector 552 reflects off the reflective surface 562 as a reflected beam 564 into the focal point 566 of the reflector 552. A portion of the light source 554, such as an electrode 570, may be located at the focal point 566, thereby providing a scattering surface (such as a Lambertian surface) that scatters the reflected beam 564 as a scattered beam 572 that reflects off the reflective surface 562 as an expanded collimated beam 580.

While the light assembly 500 is shown having the additional reflective member 558 within the reflector 552, various other light sources that emit a light beam that is parallel with the longitudinal axis 568 may be used. For example, a light source, such as a laser-emitting device, may be positioned within the reflector 552 and configured to emit a light beam toward the reflective surface 562. The emitted light beam may be parallel to the longitudinal axis 568. Light beams that are emitted toward the reflective surface and that are parallel with the longitudinal axis 568 reflect into the focal point 566, as shown.

Figure 6:
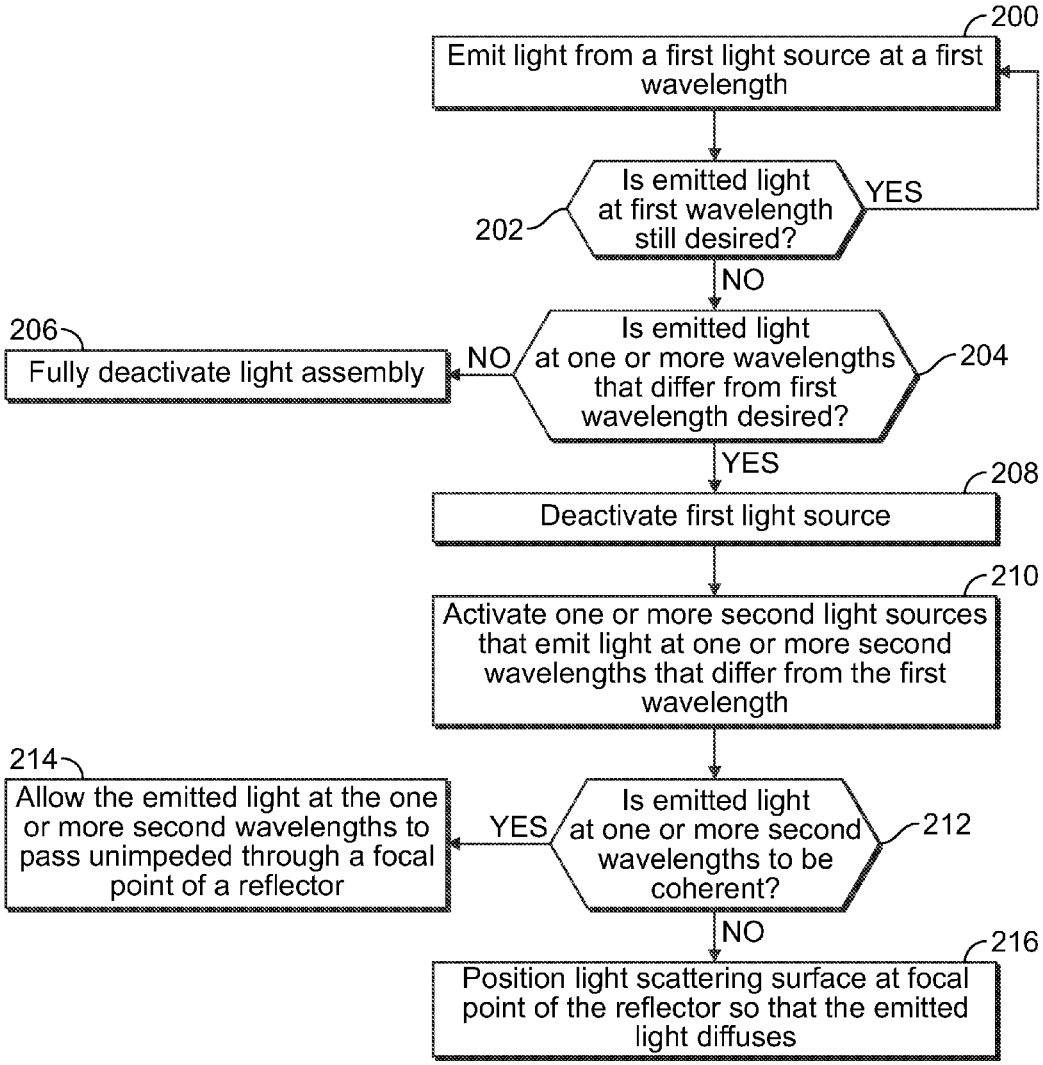
FIG. 6 illustrates a flow chart of a method of operating a light assembly, according to an embodiment of the present disclosure.

FIG. 6 illustrates a flow chart of a method of operating a light assembly, according to an embodiment of the present disclosure. At 200, light may be emitted from a first light source, such as a Xenon lamp, at a first wavelength, such as that which coincides with white light. At 202, it is determined whether emitted light at the first wavelength is still desired. If so, the method returns to 200.

If light at the first wavelength is no longer desired, the method proceeds to 204, where it is determined whether emitted light at one or more wavelengths that differ from the first wavelength is desired. If not, the method proceeds to 206, in which the light assembly is fully deactivated, such as by engaging a power switch.

If, however, emitted light at a wavelength is desired, the method proceeds from 204 to 208, in which the first light source is deactivated. Then, at 210, one or more second light sources, such as laser emitting devices, are activated to emit light at one or more second wavelengths that differ from the first wavelength.

At 212, it is determined whether the emitted light at the one or more second wavelengths is to be coherent (for example, focused and non-diffused). If so, the method proceeds to 214, in which the emitted light at the one or more second wavelengths is allowed to pass unimpeded through a focal point of a reflector. For example, a light scattering surface may be positioned or otherwise moved out of the focal point. If, however, the emitted light at the one or more second wavelengths is to be diffused, the method proceeds from 212 to 216, in which the light scattering surface (such as an electrode of a light source in the form of a lamp) is positioned at the focal point so that light emitted from the one or more second light sources diffuses off of the light scattering surface.

Alternatively, the method may omit 200-208. Instead, the method may begin with 210. For example, a light assembly may not include a standard lamp, such as a source of white light.

Figure 7:
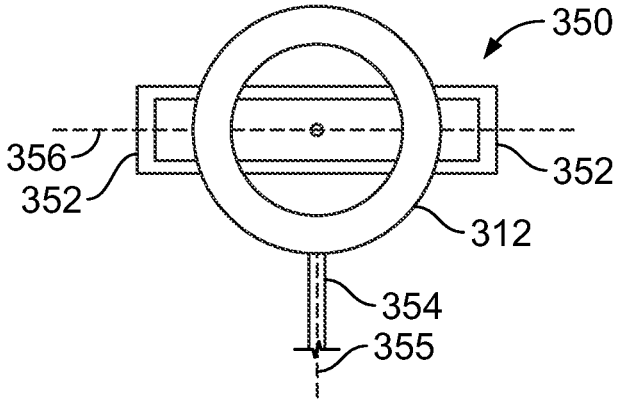
FIG. 7 illustrates a front view of a light assembly, according to an embodiment of the present disclosure.

FIG. 7 illustrates a front view of a light assembly 350, according to an embodiment of the present disclosure. The light assembly 350 may include any of the embodiments described above, and may also include handles 352 configured to be grasped by an individual. The light assembly 350 may also include a housing 312 mounted on a post 354, for example. The housing 312 may be configured to rotate about a vertical axis 355 of the post 354. Further, the housing 312 may be configured to rotate about a horizontal axis 356. As shown, the light assembly 350 may be a searchlight or spotlight.

Figure 8:
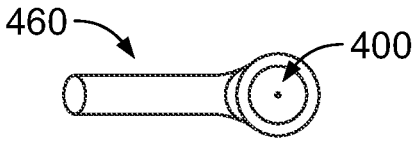
FIG. 8 illustrates a side view of a light assembly, according to an embodiment of the present disclosure.

FIG. 8 illustrates a side view of a light assembly 460, according to an embodiment of the present disclosure. The light assembly 460 may include a graspable handle connected to a light emitter 400, such as any of the assemblies described above. The light assembly 460 may be a flashlight or handheld signaling light, for example.

Referring to FIGS. 1-8, embodiments of the present disclosure provide a light assembly that may include multiple light sources, each of which may be configured to emit light at a different wavelength. The light sources may be secured with respect to an outer surface of a reflector, and configured to emit light toward a focal point of the reflector. The emitted light may pass through the focal point of the reflector in order to provide a coherent, focused collimated beam. A light scattering surface, such as a Lambertian surface (for example, an outer surface of an electrode of a lamp), may be positioned at the focal point so that emitted light from the light sources diffuses and reflects off an inner surface of the reflector as an incoherent collimated beam.

Embodiments of the present disclosure provide a light assembly that may be used to emit light beams of different colors that are emitted through the same aperture. A combination of blue, green, and red light sources, such as laser emitting devices, may vary the intensity of each emitted light beam in order to emit light at various different colors.

In at least one embodiment, a near infrared laser emitting device tuned at the peak of night vision sensitivity may provide covert illumination to be used with night vision goggles, for example.

Embodiments of the present disclosure may be used with existing searchlights, such as Xenon short-art searchlights or spotlights, by retrofitting such assemblies with additional light sources, such as laser emitting devices. Each laser emitting device may be steady or modulated at any desired frequency.

Embodiments of the present disclosure provide a light assembly that includes one or more light sources, such as laser emitting devices, that may be expanded and safe for viewing by focusing the light emitted from the one or more light sources onto a scattering surface, such as Lambertian surface (for example, an electrode of a lamp). The Lambertian surface scatters or diffuses the beam so that the reflected collimated beam that passes out of the aperture is expanded, and therefore safer to the human eye in contrast to a focused laser beam.

Embodiments of the present disclosure provide a light assembly that may include a combination of light sources, such as laser emitting devices, and/or a near infrared source that may be focused on or toward a focal point of a reflector.

Embodiments of the present disclosure provide a light assembly that may utilize the same optics, which may be or include a single reflector, for multiple light sources, such as a Xenon lamp and one or more laser emitting devices.

While various spatial and directional terms, such as top, bottom, lower, mid, lateral, horizontal, vertical, front and the like may be used to describe embodiments of the present disclosure, it is understood that such terms are merely used with respect to the orientations shown in the drawings. The orientations may be inverted, rotated, or otherwise changed, such that an upper portion is a lower portion, and vice versa, horizontal becomes vertical, and the like.

As used herein, a structure, limitation, or element that is "configured to" perform a task or operation is particularly structurally formed, constructed, or adapted in a manner corresponding to the task or operation. For purposes of clarity and the avoidance of doubt, an object that is merely capable of being modified to perform the task or operation is not "configured to" perform the task or operation as used herein.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the disclosure without departing from their scope. While the dimensions and types of materials described herein are intended to define the parameters of the various embodiments of the disclosure, the embodiments are by no means limiting and are exemplary embodiments. Many other embodiments will be apparent to those of skill in the art upon reviewing the above description. The scope of the various embodiments of the disclosure should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112(f), unless and until such claim limitations expressly use the phrase "means for" followed by a statement of function void of further structure.

This written description uses examples to disclose the various embodiments of the disclosure, including the best mode, and also to enable any person skilled in the art to practice the various embodiments of the disclosure, including making and using any devices or systems and performing any incorporated methods. The patentable scope of the various embodiments of the disclosure is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

What is claimed is:

1. A light assembly comprising:

a reflector having a focal point in space;

a first light source configured to generate a first light at a first wavelength proximate to the focal point during a first illumination mode, wherein the first light reflects off the reflector as a first collimated beam at the first wavelength; and one or more second light sources configured to direct one or more second light beams at one or more different wavelengths towards the focal point during a second illumination mode, wherein the one or more different wavelengths differ from the first wavelength, and wherein at least a portion of the one or more second light beams reflects off the reflector as one or more second collimated beams at the one or more different wavelengths.

2. The light assembly of claim 1, wherein the one or more second light sources are configured to direct the one or more second light beams unimpeded through the focal point to the reflector, and wherein the one or more second collimated beams are of the same intensity and focus as the one or more second light beams as emitted from the one or more second light sources.

3. The light assembly of claim 1, further comprising a light scattering member positioned at the focal point, wherein the light scattering beam scatters the one or more second light beams, and wherein the one or more second collimated beams are expanded in relation to the one or more second light beams as emitted from the one or more second light sources.

4. The light assembly of claim 3, wherein the light scattering member comprises at least a portion of the first light source.

5. The light assembly of claim 3, wherein the light scattering member comprises a light scattering medium that is not configured to independently generate light.

6. The light assembly of claim 4, wherein the at least a portion of the first light source comprises at least an outer surface of an electrode.

7. The light assembly of claim 1, further comprising an actuator operatively connected to the first light source, wherein the actuator is configured to selectively move at least a portion of the first light source into and away from the focal point.

8. The light assembly of claim 1, wherein the first light source comprises an arc lamp, and wherein the one or more second light sources comprises one or more laser emitting devices.

9. The light assembly of claim 1, wherein the one or more second light sources comprises multiple second light sources.

10. A method of operating a light assembly, comprising:

generating a first light at a first wavelength with a first light source during a first illumination mode;

reflecting the first light off a reflector as a first collimated beam at the first wavelength;

directing one or more second light beams at one or more different wavelengths towards a focal point of the reflector from one or more second light sources during a second illumination mode that differs from the first illumination mode, wherein the one or more different wavelengths differ from the first wavelength, and reflecting at least a portion of the one or more second light beams off the reflector as one or more second collimated beams at the one or more different wavelengths.

11. The method of claim 10, wherein the directing the one or more second lights beams comprises directing the one or more second light beams unimpeded through the focal point to the reflector, and wherein the one or more second collimated beams are of the same intensity and focus as the one or more second light beams as emitted from the one or more second light sources.

12. The method of claim 10, further comprising scattering the one or more second light beams with a light scattering member positioned at the focal point, and wherein the one or more second collimated beams are expanded in relation to the one or more second light beams as emitted from the one or more second light sources.

13. The method of claim 10, further selectively moving at least a portion of the first light source into and away from the focal point.

14. A light assembly comprising:

a reflector having a focal point in space; and one or more light sources secured with respect to an outer surface of the reflector, wherein the one or more light sources are configured to direct one or more light beams at one or more different wavelengths towards the focal point, wherein at least a portion of the one or more light beams reflects off the reflector as one or more collimated beams at the one or more different wavelengths.

15. The light assembly of claim 14, wherein the one or more light sources are outside of a reflecting volume of the reflector.

16. The light assembly of claim 14, wherein the one or more light sources are configured to direct the one or more light beams unimpeded through the focal point to the reflector, and wherein the one or more collimated beams are of the same intensity and focus as the one or more light beams as emitted from the one or more light sources.

17. The light assembly of claim 14, further comprising a light scattering member positioned at the focal point, wherein the light scattering beam scatters the one or more light beams, and wherein the one or more collimated beams are expanded in relation to the one or more light beams as emitted from the one or more light sources.

18. The light assembly of claim 17, wherein the light scattering member comprises at least a portion of an additional light source that is separate and distinct from the one or more light sources.

19. The light assembly of claim 17, wherein the light scattering member comprises a light scattering medium that is not configured to independently generate light.

20. The light assembly of claim 17, further comprising an actuator operatively connected to the light scattering member, wherein the actuator is configured to selectively move at least a portion of the light scattering member into and away from the focal point.

* * * * *